United States Patent [19]

Louis

[11] Patent Number: 4,712,774

[45] Date of Patent: Dec. 15, 1987

[54] DEVICE FOR THE MELTING OF LIGHT METALS

[75] Inventor: Raymond Louis, Montmagny, France

[73] Assignee: Gaz de France, Paris, France

[21] Appl. No.: 811,787

[22] Filed: Dec. 20, 1985

[30] Foreign Application Priority Data

Dec. 20, 1984 [FR] France ..... 84 19543

[51] Int. Cl.[4] ..... F27B 14/02

[52] U.S. Cl. ..... 266/155; 266/900; 266/901

[58] Field of Search ..... 266/900, 901, 155; 75/65 R, 68 R

[56] References Cited

U.S. PATENT DOCUMENTS 2,752,235 6/1956 Burke .
3,186,830 6/1965 Moore et al. ..... 266/900
3,276,758 10/1966 Baker et al. .
4,010,935 3/1977 Stephens .
4,021,192 5/1977 Ferguson et al. ..... 266/901
4,457,494 7/1984 Fisher ..... 266/901

*Primary Examiner*—Melvyn J. Andrews
*Attorney, Agent, or Firm*—Pollock, VandeSande & Priddy

[57] ABSTRACT

The invention pertains to a process and a device for the melting and holding in the molten state light metal alloy loads. There are provided two chambers respectively referred to as the loading-melting chamber and the holding-tapping chamber, interconnected by a channel with reduced section. The loading-melting chamber is placed at a level which is above that of the other chamber and a space under the loading-melting chamber houses a heat exchanger for heating the combustion air by combustion products.

5 Claims, 3 Drawing Figures

DEVICE FOR THE MELTING OF LIGHT METALS

FIELD OF THE INVENTION

The invention relates to a process and a device for the melting and holding in the molten state light metal alloy loads.

BACKGROUND OF THE INVENTION

Furnaces which comprise a loading chamber in which the melting of light metal loads occurs, are known. These furnaces have a loading chamber connected to a chamber which is placed at a lower level, in which the bath is held in the molten state and in which its tapping occurs. These furnaces are utilized especially for melting light metals and the casting of new parts.

The problem which arises with this type of installation is that it pertains to relatively small units, the operation of which must be as simple and reliable as possible, and which yield must be as high as possible.

The object of the invention is a process and a device for the improved melting of light metal alloy loads. The furnace constructed in accordance with the invention specifically possesses improved compactness and thermal yield in comparison to similar known devices.

The process in accordance with the invention for the melting and holding in the molten state of light metal alloy loads is the type which utilizes a furnace comprising a first loading chamber, which is placed at an upper level, in which the melting occurs, being connected by a channel to a second chamber which is placed at a lower level, in which the bath is kept in the molten state and in which its tapping occurs, with each chamber having a separate burner and with the furnace being endowed with a common evacuation chimney for the combustion fumes produced in each chamber. According to the invention, the process is characterized in that, at an intermediary level, towards the bottom of the first chamber, an exchange of heat is effected between the combustion products and the combustion air utilized for at least one of the burners. In this manner, a particularly compact construction and a notably improved thermal yield are at once obtained, due to the thermal exchange with the combustion products issuing from the two burners before their escape through the chimney.

According to another characteristic of the process according to the invention, a complete loading of the first chamber with the products to be melted is provided, the burner is placed in said loading chamber, approximately at an axial end of said chamber, with the burner being directed towards the other end and with only one passage, connecting with the lower chamber, having a very small section, being provided at a low point in said loading chamber. In this manner, a maximum heating yield is obtained for the load to be melted, and the melting process for the load, which is placed entirely in the flux of heat directed in the axial plane of the chamber, is accelerated.

According to another characteristic of the process according to the invention, the holding burner is placed in said lower holding and tapping chamber, towards the ceiling of said chamber, with said burner being of the flat radiating flame type. In this manner, the holding of the molten state of the bath is achieved under the best conditions, while reducing the agitation of the bath and the formation of oxidation products.

The invention also pertains to a device for the implementation of the aforementioned process, which comprises two adjacent modules, with one placed at a higher level than the other, respectively forming the aforementioned upper loading-melting chamber and the lower holding-tapping chamber, and a heat exchanger for the combustion air/combustion products, which is placed approximately under the base of the upper chamber and beside the internal lateral wall of the lower chamber.

BRIEF DESCRIPTION OF THE FIGURES

The invention and its embodiment will emerge more clearly with the aid of the following description, which is given in reference to the attached drawings, in which.

DETAILED DESCRIPTION OF THE INVENTION

Figure 1:
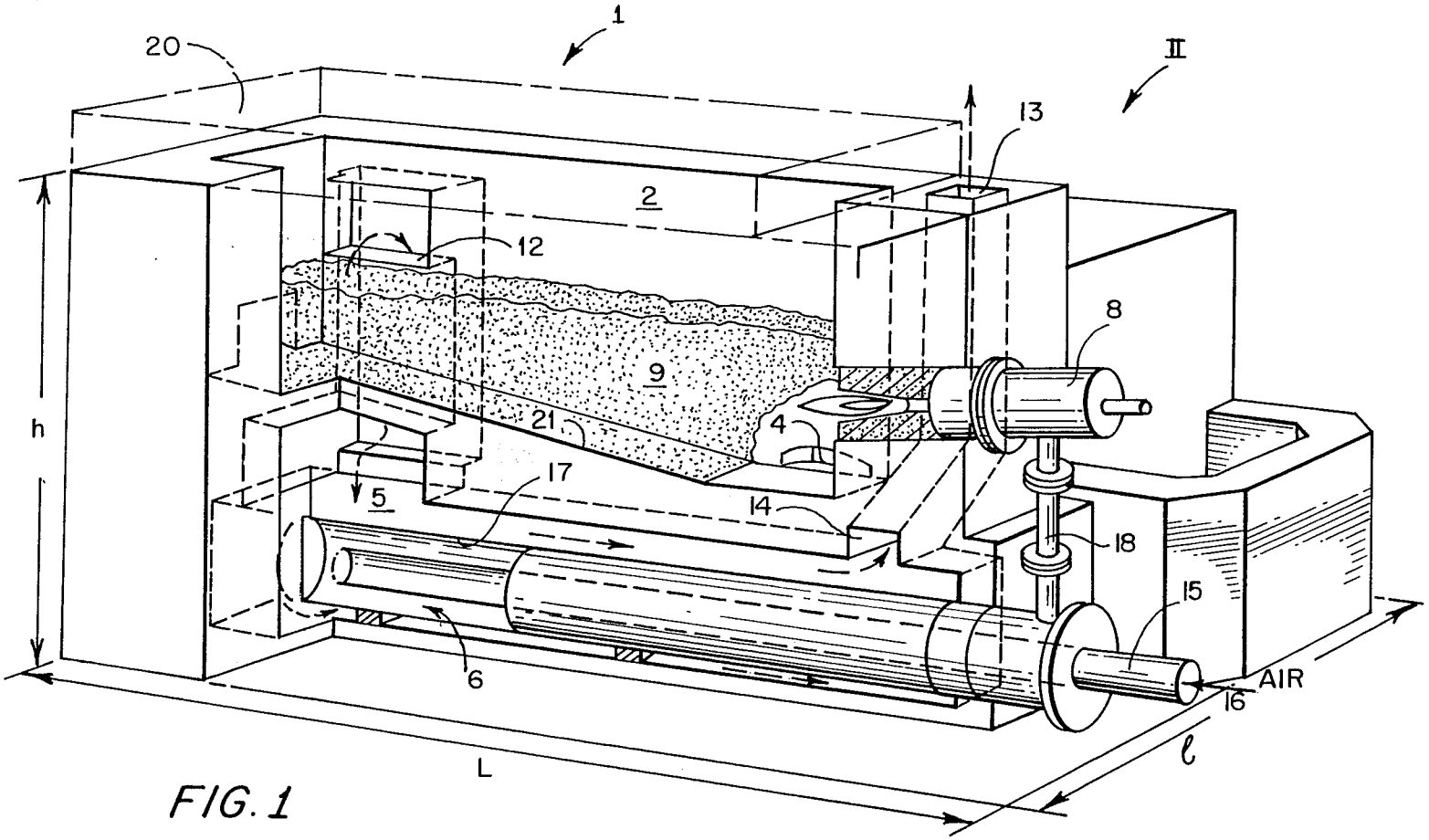
FIG. 1 is a perspective view with cutaway, showing an overall device in accordance with the invention.

In reference to the diagrams, the overall device which is designated 1 essentially comprises an upper loading-melting chamber 2, connected by a narrow passage in the form of a channel 4 with a lower holding-tapping chamber 3. Below the upper chamber 2, a circulation area 5 for the fumes is formed, in which a heat exchanger-blast heating apparatus 6 is inserted. The holding-tapping chamber 3 is connected to the outside by two lateral drainage spouts.

A gas burner 8, placed approximately at one end of the chamber 2 along the median axis of this chamber, is provided for the heating of the loading-melting chamber 2. Thus, the burner heats the load 9 over its entire length, and more so towards its end which is near the burner, which is also close to the channel 4 connecting with the lower chamber 3.

The lower holding-tapping chamber 3 is heated by a burner 10 of the flat radiating flame type, designated as 11. Burner 10 is, mounted towards the ceiling of said chamber 3, as is clearly shown in FIG. 2.

Figure 2:
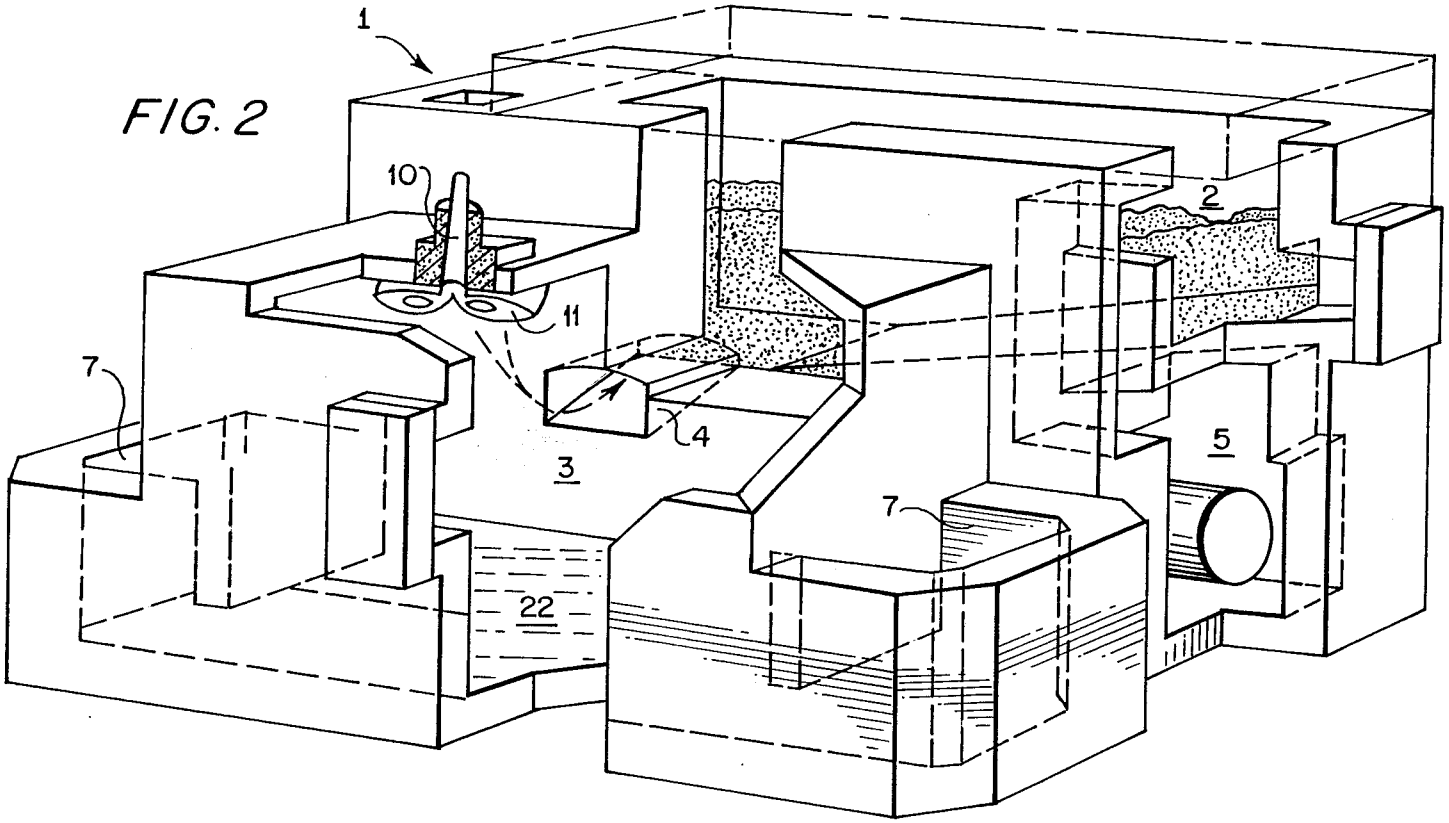
FIG. 2 is a similar view to that in FIG. 1, but as seen from the other side, in the direction of arrow II in FIG. 1.

The circulation of the combustion gases occurs as indicated by the various arrows in FIGS. 1 and 2.

The combustion products issuing from the lower chamber 3 pass through the channel 4, entering the loading chamber 2 in which they are blended with the combustion products produced by the burner 8. As is more clearly shown in FIG. 1, the combustion products in chamber 2 rise first from the base of the chamber to be taken in towards the upper part by an inverted circuit conduit 12 connecting with the area 5 formed under the base of chamber 2 and against the lateral wall of chamber 3. The combustion products issue at the other end of the area 5 through the chimney conduit 13 connected with the area 5 by an opening 14.

The inserted blast heating apparatus 6 is formed by an internal conduit 15 at which the cold air enters in 16 and which is housed inside a conduit 17, which is slightly longer and larger in diameter. The hot air is carried by a conduit 18 to the burner 8, and also to the burner 10 so that the combustion air is preheated in the heat exchange with the combustion products, before their escape through the chimney.

Figure 3:
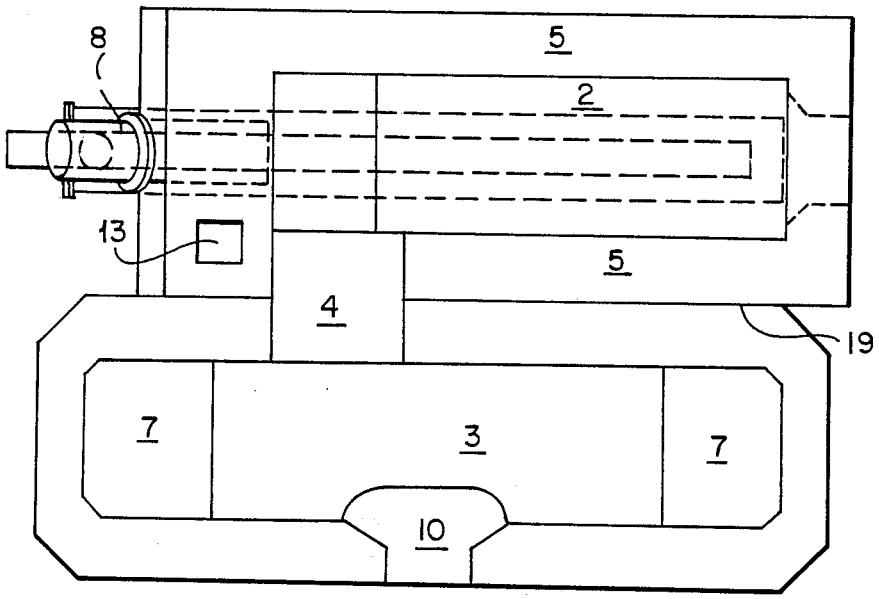
FIG. 3 is a top view of the installation, illustrating the respective placement of the two chambers.

As is clearly shown by the diagrams, the construction is particularly compact and the compactness is used advantageously to reduce heat loss to the outside and to improve the yield of the blast heating apparatus 6. In FIG. 3, one notes that the area 5 is adjacent to the median vertical plane 19 of the structure, which is straddled by the channel 4.

In the operating position, the base of the chamber 3 and the base of the area 5 are in a same plane and form a support base for the overall device.

For loading the furnace through the load 9, the cover 20 is moved horizontally, with it simply coming to rest on the loading chamber 2; the cover is put back into place before the startup of the installation.

The slightly inclined base 21 of the chamber 2 guides the fusion products towards the channel 4 with a reduced section which connects to the chamber 3, thus preventing the unmelted metal loads from falling into the chamber 3. The spouts 7 are normally blocked by a cover (not shown) which limits heat loss and delays oxidation. The cover is removed when we drain some of the molten load.

In an example of an embodiment corresponding to the melting of a 675 kg load of aluminum, the melting of the load was completed in 45 minutes. The combustion yield of the burners was 72% and the heating yield was 55%.

The implementation of the device is effected in the following manner.

The metal to be melted, in ingot, scrap or other forms, is loaded into chamber 2, whose cover 20 has been removed. After the cover is put back into place, the burner 8 is lit. The metal melts, preheats and flows off, approximately at its liquefaction temperature, towards the holding chamber 3.

The combustion products, having been used to melt and preheat the load, circulate in the area 5 before issuing through the chimney 13 and thus ensure the preheating of the burner combustion air.

A new load is introduced into the melting cell 2. As long as the quantity of molten bath 22 in the chamber 3 is sufficient, the burner 8 is not lit, and the burner 10 alone operates, holding the bath 22 in its molten state. The combustion products issuing from the chamber 3 escape through the chamber 2, then through the area 5 and finally to the chimney, which is used to preheat the load to be melted as well as the combustion air in the exchanger-blast heating apparatus 6. The burner is lit only if the level of the bath 22 becomes too low.

Due to the form and the special installation of the burner 10, the agitation of the molten bath 22 is reduced, and the undesirable phenomena of oxidation as well as those of bubble formation resulting from an excessive agitation of the bath are eliminated.

For aluminum alloys, experience has shown that specific furnace consumption was only about 570 kWh/t (kilowatt hours per ton).

For the practical embodiment of the structure, the modules comprising the three juxtaposed areas of chamber 2, chamber 3 and area 5 are advantageously made of refractory concrete surrounded by a steel wall. The cover 20 can be made of fibrous refractory material for sealing purposes.

In the example described, the complex had an outside-to outside length L=2.85 m, an outside-to-outside width 1=2 m and a height (without cover) h=1.30 m. Of course, the size of the installation can be increased if it is desirable to expand the capacity of the unit.

What is claimed is:

1. Apparatus for melting and holding light metal alloy loads in the molten state, the apparatus including a furnace comprising:

a first chamber positioned at a first level for loading the metal alloy, the first chamber having a first burner for melting the alloy into a molten bath;

a second chamber, having a second burner, positioned at a level lower than the first chamber for holding the molten bath, the second burner maintaining the molten bath in the molten state for tapping;

a channel connecting the first chamber to the second chamber for allowing the molten bath to flow from the first chamber to the second chamber;

an exhaust means connected to the first and second chambers for evacuating combustion fumes produced in each of the chambers; and a heat exchanger having air for combustion of the burners inputted thereto, the heat exchanger being positioned substantially under the first chamber and adjacent to an internal lateral wall of the second chamber for heating the combustion air with combustion products produced in the chambers.

2. Apparatus according to claim 1, further comprising:

a fume circulation chamber, positioned partially beneath the first chamber, for housing the heat exchanger, the fume circulation chamber connecting the first chamber to the exhaust means for providing an evacuation path for the combustion fume from the first chamber.

3. Apparatus according to claim 1, wherein the channel connecting the first and second chambers substantially straddles the chambers on a common vertical connection plane.

4. Apparatus according to claim 2, wherein the second chamber and the fume circulation chamber have substantially coplanar bases; and wherein the apparatus further comprises:

a substantially flat base for the furnace formed at least from the base of the second chamber and the base of the fume circulation chamber containing the heat exchanger.

5. Apparatus according to claim 3, wherein the second chamber is connected to an environment outside of the apparatus by at least one lateral spout.

* * * * *